US007988348B2

(12) United States Patent
Morgenthaler

(10) Patent No.: US 7,988,348 B2
(45) Date of Patent: Aug. 2, 2011

(54) TURBINE DRIVEN MIXER

(76) Inventor: Michael R. Morgenthaler, Houston, TX (US)

( * ) Notice: Subject to any disclaimer, the term of this patent is extended or adjusted under 35 U.S.C. 154(b) by 660 days.

(21) Appl. No.: 12/217,403

(22) Filed: Jul. 3, 2008

(65) Prior Publication Data

US 2009/0016153 A1 Jan. 15, 2009

Related U.S. Application Data

(60) Provisional application No. 60/958,911, filed on Jul. 10, 2007.

(51) Int. Cl.
*B01F 5/16* (2006.01)

(52) U.S. Cl. ..... 366/137; 366/168.2; 366/169.1

(58) Field of Classification Search ..... 366/136, 366/137, 168.2, 169.1, 170.4; 415/55.3, 415/55.5, 122.1; 440/5
See application file for complete search history.

(56) References Cited

U.S. PATENT DOCUMENTS 2,566,892 A * 9/1951 Jacobs ..... 415/55.5
3,692,420 A * 9/1972 Mittelstaedt ..... 415/62
3,704,865 A 12/1972 Kharitonov et al.
4,097,927 A 6/1978 Sendov et al.
4,252,445 A 2/1981 Underwood
4,660,988 A 4/1987 Hara et al.
5,511,881 A 4/1996 Post et al.
5,558,434 A 9/1996 Hamada et al.
5,620,250 A * 4/1997 Chilcoat et al. ..... 366/168.2
5,899,560 A * 5/1999 Byers ..... 366/137
6,109,778 A 8/2000 Wilmer
7,854,582 B2 * 12/2010 Ullyott ..... 415/1
2006/0285431 A1 * 12/2006 Wu et al. ..... 366/167.2

* cited by examiner

*Primary Examiner* — Robert B Davis

(74) *Attorney, Agent, or Firm* — John R. Casperson

(57) ABSTRACT

An improved fluid mixing apparatus is disclosed for the mechanical mixing of fluids or solids-laden slurries contained within a vessel. The invention utilizes a fluid driven turbine to drive a submerged mixing impeller through a speed reducing gearbox. A fluid conducting stator houses one or more turbine blade row(s) that are rotated as a working fluid is pumped through the turbine section by an external pump that circulates fluid at the required flow rate and head. The turbine shaft is rigidly connected to the high speed input shaft of a speed reducing gear box. The low speed output of the gearbox is rigidly attached to submerged mixing impeller(s).

16 Claims, 2 Drawing Sheets

TURBINE DRIVEN MIXER

CROSS REFERENCES TO RELATED APPLICATIONS

This application claims the benefit of U.S. Provisional Application No. 60/958,911 filed Jul. 10, 2007, the disclosure of which is herein incorporated by reference.

FIELD OF THE INVENTION

The field of the invention is the mechanical mixing of fluids or solids-laden slurries stored in vessels or tanks.

BACKGROUND OF THE INVENTION

The process of mixing liquids stored in tanks has been extensively studied and is important in many industries, for example, chemical processing, municipal water treatment, mining, and oil well drilling. Similarly, the design of fluid driven turbines is well known including fluid driven "mud motors" designed for downhole use in well drilling applications. The technologies, however, have not heretofore been combined in a mixing apparatus.

OBJECTS OF THE INVENTION

It is an object of the invention to power a mixing impeller with a turbine. Powering a mixing impeller with a turbine has several potential advantages over prior art techniques. The working fluid for the turbine section can be the same fluid as the fluid being mixed because the working fluid exiting the turbine section can be discharged to the body of fluid being mixed. The apparatus can be installed inside of the vessel being mixed and can be completely submerged by floor mounting, eliminating the need for obstructing usable work space on the top of tanks as is common when installing top driven agitators. The combination would also eliminate the hazard and special precautions that must be taken for electrical motor-driven mixers when flammable fluids are being mixed. Also, a turbine driven mixer could be mounted in the bottom of the tank, reducing the required shaft length and the weight and the moment arm forces that must be supported by the bearings in the mixer. Additionally, using a working fluid drive would permit the mixing impeller to accelerate slowly at much lower shock and torque loads than in a direct driven turbine mixer.

SUMMARY OF THE INVENTION

The present invention is directed to the mixing of fluids or slurries as required to maintain homogeneous fluid properties, blend constituents, and/or suspend solids. In a preferred embodiment, the invention comprises a submersible mixer assembly that utilizes a conventional multi-bladed mixing impeller powered by a fluid driven turbine through an r.p.m. reducer. The r.p.m. reducer permits each of the turbine and the mixing impeller to turn at near optimal rpm.

One embodiment of the invention is provided in the form of an apparatus comprising a turbine housing, a turbine shaft, rotor blades, a reduction gearbox, and impeller blades. The turbine housing defines an axial passage having an inlet end and an outlet end. The turbine shaft is axially mounted in the passage and has an output end protruding beyond the outlet end of the passage. A row of radially outwardly extending rotor blades is fixedly mounted to the turbine shaft between the inlet end and the outlet end of the housing. The r.p.m. reducer is mounted to the output end of the turbine shaft. A plurality of the impeller blades is mounted to the r.p.m. reducer.

In another embodiment of the invention, the just-described apparatus can be employed, in combination with a vessel, in a method for mixing a liquid-based mixture. The mixture is provided in the vessel. A turbine, coupled to a mixing impeller via reduction gearing, is positioned in the vessel, the mixing impeller being immersed in the mixture. Fluid is flowed through the turbine to drive the impeller and mix the liquid-based mixture.

The working fluid for the turbine is preferably the same fluid as that contained within the vessel being mixed. However, it can be from an outside source, or it can be fluid contained in a closed loop segregated from the process by shaft seals. The working fluid is forced by an external pump through the turbine stage(s) to deliver power to a speed reducing gearbox and the low speed output of the gearbox is rigidly attached to the mixing impeller. The working fluid exiting the turbine section is preferably discharged to the vessel being mixed where it commingles with the fluid being mixed.

DETAILED DESCRIPTION OF THE INVENTION

Figure 1:
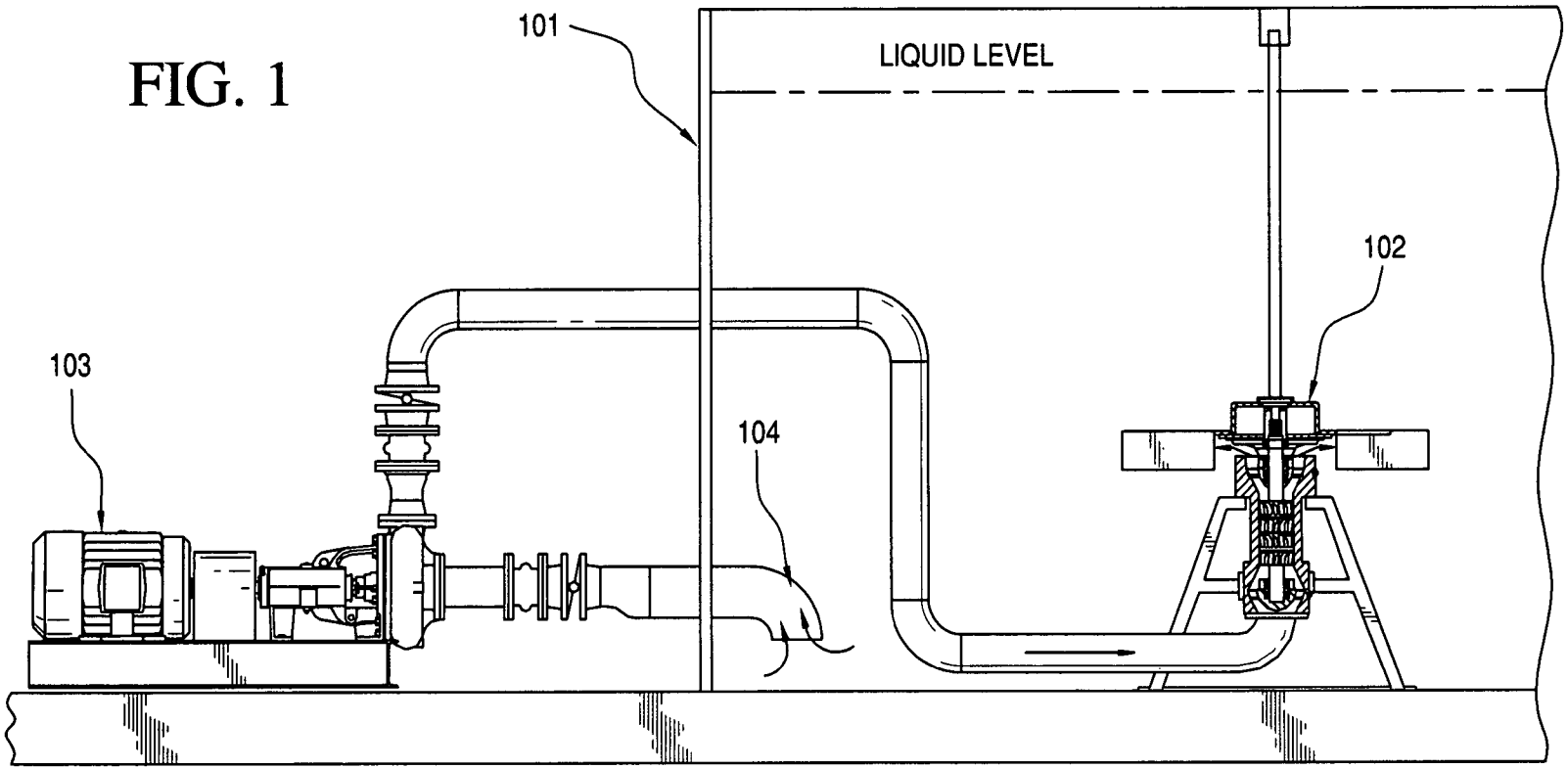
FIG. 1 is a schematic illustration of a fluid circuit for a turbine driven mixing apparatus in accordance with an embodiment of the invention.

One embodiment of the invention is provided in the form of an apparatus comprising a turbine housing, a turbine shaft, rotor blades, an r.p.m. reducer, and impeller blades. The turbine housing defines an axial passage having an inlet end and an outlet end. The turbine shaft is axially mounted in the passage and has an output end protruding beyond the outlet end of the passage. A row of radially outwardly extending rotor blades is fixedly mounted to the turbine shaft between the inlet end and the outlet end of the housing. A row of radially inwardly extending stator blades is preferably fixedly mounted to the turbine housing at a position adjacent to the row of rotor blades and the apparatus more preferably comprises multiple rows of rotor blades and stator blades. The r.p.m. reducer is mounted to the output end of the turbine shaft. A plurality of the impeller blades is mounted to the r.p.m. reducer. The r.p.m. reducer will generally comprise a reduction gearbox and the impeller blades can be mounted to the outer surface of the reduction gearbox. Alternatively, where the reduction gearbox has an output shaft, the impeller blades can be mounted to it.

The reduction gearbox is preferably rotationally carried by the turbine shaft and the impeller blades revolve more slowly than the turbine shaft and about the same axis. The reduction gearing can vary over a wide range depending on the application, but will generally be in the range of 3:1 to 30:1 and usually in the range of 6:1 to 15:1. By mounting the impeller blades to the reduction gearbox casing, the necessity of an output shaft seal for the reduction gearbox can be avoided. The reduction gearbox preferably has a generally cylindrical outside surface, and the impeller blades preferably extend radially outwardly therefrom, the gearbox casing serving as a hub for the impeller blades.

In the illustrated embodiment, a lower bearing pedestal is fixedly mounted in the turbine housing near the inlet end of the housing for rotationally carrying a lower end of the turbine shaft, and an upper bearing pedestal fixedly is mounted in the turbine housing near the outlet end for rotationally carrying an upper end of the turbine shaft. A support base structure is connected to an outer surface of the turbine housing to position the turbine housing so that the axial passage is vertically oriented and the inlet to the axial passage is spaced apart from a lower end of the support base structure.

In an alternative design, (not shown), the turbine is mounted to a support structure so that the axial passage is generally horizontally positioned. The turbine output shaft is connected to an r.p.m. reducer in the form of a right angle drive gearbox, preferably including reduction gearing. The impeller blades are connected to a vertically positioned output shaft of the reduction gearbox. When constructed in this manner, the resulting assembly has a low profile and is highly suitable for use in shallow tanks.

The apparatus is used in combination with a vessel and a pump. The vessel comprises a sidewall, a lower end closure, and an upper end closure. The support base structure is mounted to the lower end closure of the vessel to position the turbine housing, in the preferred embodiment, vertically within the vessel. The pump has an inlet and an outlet. When the turbine working fluid comprises recirculated mixture, a first conduit connects the inlet of the pump to a lower inside portion of the vessel, and second conduit connects the outlet of the pump to the inlet end of the turbine housing. A tubular shaft is preferably also provided. The tubular shaft connects the upper end closure of the vessel with an upper end of the gearbox. It is mounted to the upper end closure for rotational movement and the inside of the tube is accessible from outside the tank, to provide venting and a path to permit adding oil as needed to the gearbox. If desired, a gearbox totally sealed from the outside environment could be employed, for example, by providing it with an inside bladder to accommodate expansion and contraction of the oil to avoid unnecessarily stressing the gearbox seals.

FIG. 1 illustrates a loop circulation system consisting of a vessel 101 in which a fluid driven turbine mixing apparatus 102 is installed. A pump 103 circulates fluid to and from the vessel 101 by pumping through the mixing apparatus 102. The pump inlet nozzle 104 has a flooded suction fluidly connected to the contents of the vessel 101. The working fluid discharges from the mixing apparatus 102 into the vessel where the working fluid freely mixes with the fluid being mixed. This commingling of working fluid and fluid being mixed is preferred in some applications because the density of the working fluid will always match the density of the fluid being mixed.

In some applications, for example, the mixing of oil well drilling fluids, the fluid density will vary. It is important that shaft power delivered by the turbine increases proportionally to the density of the fluid being mixed, otherwise the rotational speed of the mixer impeller will slow as the required mixing torque increases with fluid density. When a centrifugal pump is used to deliver fluid at a specific head to drive the turbine, the centrifugal pump will draw more power from its prime mover to maintain constant discharge head as fluid density increases. Since working fluid density in a circulation system like that shown in FIG. 1 must have the same density as the fluid being mixed, the shaft power delivered by the apparatus will match the increased power requirements of the mixing impeller as fluid density varies provided the pump delivers nearly constant discharge head.

The power output or brake horsepower of a fluid turbine is given by:

$$P_{hpb}=\eta\rho Qh\div 33000 \quad \text{[Eqn 1]}$$

Where:

$P_{hpb}$=brake horsepower $\eta$=efficiency $\rho$=fluid density (lb/ft$^3$)

Q=volume flow rate (ft$^3$/min)

h=head (feet)

For fluid driven turbines, it is known that higher head and higher rotational speeds are conducive to higher efficiency. It also known as a general rule that when mixing fluids or suspending solid laden slurries with specific gravities close to 1.0 that roughly 1 to 2 horsepower per 1000 gallons of fluid will need to be delivered to the fluid when a rotating multi-bladed impeller is used to impart flow and shear. Many mixing impeller applications require the impeller to rotate at around 60 rpm.

The ability of a fluid driven turbine to generate the power required to drive a conventional 4 blade mixing impeller can be illustrated with the following example. If a centrifugal pump is used to pump a fluid with specific gravity 1.0 through the turbine section of the apparatus and that this pump delivers 600 gallons per minute (80 ft$^3$/min) at 100 feet of head, then the brake horsepower of the turbine shaft can be calculated to be 11.4 horsepower, if efficient. It follows from the equation above that if the specific gravity of the fluid were 2.0, then the shaft power would be 22.8 horsepower. Obviously, the mixing apparatus is scalable and can be designed to work with different flow rates or a different heads so that a wide variety of process power requirements can be met.

Impeller power calculations are well known for the mixing of Newtonian fluids using conventional mixing impellers in standard vessel geometries. In that case, the power required can be calculated using:

$$P=N_p\rho N^3D^5 \quad \text{[Eqn 2]}$$

Where:

P=power in watts $N_p$=power number (dimensionless but always less than 1.7)

$\rho$=fluid density (kg/m$^3$)

N=rotational speed (sec$^{-1}$)

D=impeller diameter (m)

The power requirement can be estimated for a 36 inch impeller turning 60 rpm by assuming that 1.7 is the power number for a given tank/impeller geometry. The power required to rotate the impeller at 60 rpm calculates to 9.9 horsepower for fluid of specific gravity of 1.0 which is less than the above calculated 11.4 shaft brake horsepower for fluid turbine mixing apparatus.

Therefore a mixing impeller can be driven by a fluid turbine with single stage centrifugal pump.

Figure 2:
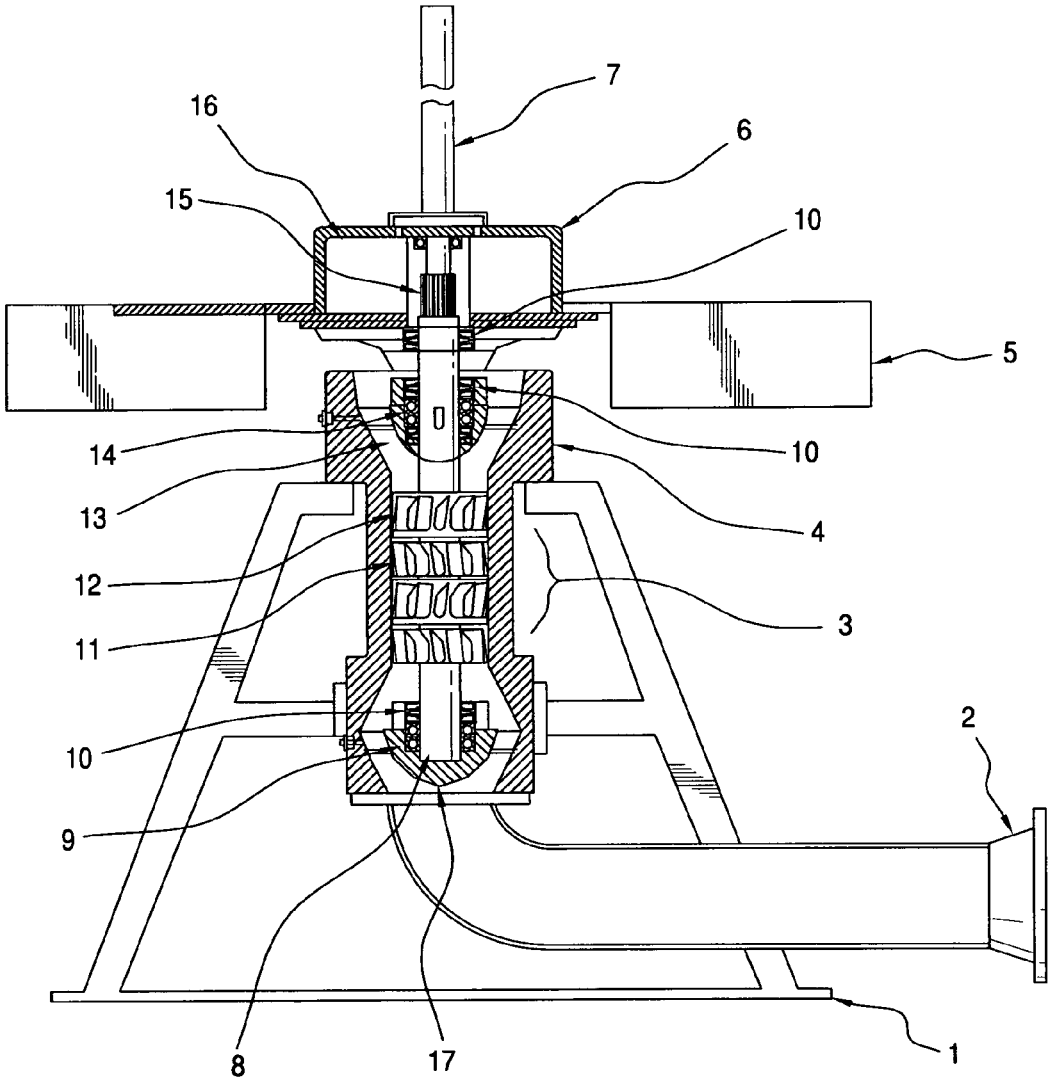
FIG. 2 is a cross sectional view of a turbine driven mixing apparatus in accordance with an embodiment of the invention.

FIG. 2 illustrates a preferred embodiment of the invention. The discharge of an external pump, not shown, will be directed to the inlet nozzle 2 attached to the mixer base 1. The fluid will flow through the turbine section 3 consisting of one or more stages (two are shown) of stator blade rows 11 and rotor blade rows 12 that are located inside the fluid conducting housing 4 containing the lower bearing pedestal 17 and the upper bearing pedestal 13. Turbine shaft seals 10 protect the thrust bearings 9 located in the lower pedestal 17 from the working fluid. The upper bearings 14 are similarly protected by shaft seals 10. The turbine shaft 8 transmits power to the gearbox 6 by using a male spline 15 to rotate the internal gearing (not shown) in the gearbox 6. The gearbox 6 is connected to the turbine shaft 8 in a manner that prevents axial movement, but allows rotation in response to the power input from the turbine shaft 8. A shaft seal 10 prevents working fluid ingress into the gear box 6 and oil loss from the gearbox 6. Since the gearbox is filled with oil, a rotating vent pipe 7 maintains constant pressure in the gearbox 6 as the temperature of the oil varies. The vent pipe 7 terminates above the highest liquid level in the vessel and also permits oil level to be checked when the mixer is not in operation. The impeller blades 5 will be rigidly attached to the gearbox housing 6 and will impart flow and shear to the fluid being mixed as the gearbox 6 rotates. The speed reducing gearbox 6 permits the mixing impeller blades 5 to rotate at an optimal speed range around 60 rpm while the turbine blade rows 12 turn at a speed range around 600 rpm for higher efficiency.

The just-described apparatus can be employed, in combination with a vessel, in a method for mixing a liquid-based mixture. The mixture is provided in the vessel. A turbine, coupled to a mixing impeller via reduction gearing, is positioned in the vessel, the mixing impeller being immersed in the mixture. Fluid is flowed through the turbine to drive the impeller and mix the liquid-based mixture. In a preferred embodiment, the liquid-based mixture comprises a slurry and the fluid flowing through the turbine comprises recirculated slurry. In such case, the fluid flowing through the turbine is exhausted into the vessel. However, the working fluid can comprise only a component of the slurry, or it can be maintained totally separate from the slurry in a closed loop system.

While certain preferred embodiments of the invention have been described herein, the invention is not to be construed as being so limited, except to the extent that such limitations are found in the claims.

What is claimed is:

1. Apparatus comprising a turbine housing defining an axial passage having an inlet end and an outlet end, a turbine shaft axially mounted in the passage and having an output end protruding beyond the outlet end of the passage, a row of radially outwardly extending rotor blades fixedly mounted to the turbine shaft between the inlet end and the outlet end of the housing, an r.p.m. reducer mounted to the output end of the turbine shaft, and a plurality of impeller blades radially mounted to the r.p.m. reducer.

2. Apparatus as in claim 1 wherein the r.p.m. reducer comprises a reduction gearbox is carried by the turbine shaft and the impeller blades revolve more slowly than the turbine shaft and about the same axis, said impeller blades being mounted to the reduction gearbox.

3. Apparatus as in claim 1 further comprising a row of radially inwardly extending stator blades fixedly mounted to the turbine housing at a position adjacent to the row of rotor blades.

4. Apparatus as in claim 1 further comprising a lower bearing pedestal fixedly mounted in the turbine housing near the inlet end of the housing for rotationally carrying a lower end of the turbine shaft, and an upper bearing pedestal fixedly mounted in the turbine housing near the outlet end for rotationally carrying an upper end of the turbine shaft.

5. Apparatus as in claim 1 further comprising a support base structure connected to an outer surface of the turbine housing to position the turbine housing so that the axial passage is vertically oriented and the inlet to the axial passage is spaced apart from a lower end of the support base structure.

6. Apparatus as in claim 2 wherein the reduction gearbox has a reduction ratio in the range of 3:1 to 30:1.

7. Apparatus as in claim 2 wherein the reduction gearbox has a reduction ratio in the range of 6:1 to 15:1.

8. Apparatus as in claim 5 further comprising a vessel comprising a sidewall, a lower end closure, and an upper end closure, wherein the support base structure is mounted to the lower end closure of the vessel to position the turbine housing within the vessel.

9. Apparatus as in claim 8 further comprising a pump having an inlet and an outlet, a first conduit connecting the inlet of the pump to a lower inside portion of the vessel, and a second conduit connecting the outlet of the pump to the inlet end of the turbine housing.

10. Apparatus as in claim 9 further comprising a tubular shaft connecting the upper end closure of the vessel with an upper end of the gearbox, said tubular shaft being mounted to the upper end closure for rotational movement.

11. A method for mixing a liquid-based mixture, said method comprising providing the mixture in a vessel, providing a turbine in the vessel, said turbine being coupled to a mixing impeller in the vessel via reduction gearing, said mixing impeller being immersed in the mixture, and flowing fluid through the turbine to drive the impeller and mix the liquid based mixture.

12. A method as in claim 11 wherein the liquid-based mixture comprises a slurry.

13. A method as in claim 12 wherein the fluid flowing through the turbine comprises recirculated slurry.

14. A method as in claim 12 wherein the fluid flowing through the turbine comprises a component of the slurry.

15. A method as in claim 12 wherein the fluid flowing through the turbine is maintained separate from the slurry.

16. A method as in claim 13 wherein fluid flowing through the turbine is exhausted into the vessel.

* * * * *